United States Patent [19]

Taylor et al.

[11] Patent Number: 4,969,610

[45] Date of Patent: Nov. 13, 1990

[54] ROPE REWINDING DEVICE FOR A SKI BOAT

[76] Inventors: Jerry Taylor, P.O. Box 202; James Sickmeyer; Rebecca Sickmeyer, both of Rte. 1, Box 107, all of Campbell Hill, Ill. 62916

[21] Appl. No.: 283,508

[22] Filed: Dec. 12, 1988

[51] Int. Cl.[5] ..... B65H 75/48

[52] U.S. Cl. ..... 242/86.5 A; 114/254; 242/107

[58] Field of Search ..... 242/107, 86.5 A, 86, 242/96, 106; 114/254

[56] References Cited

U.S. PATENT DOCUMENTS

| | | | |
|---|---|---|---|
| 3,162,395 | 12/1964 | Bray | 242/86.5 A |
| 3,315,914 | 4/1967 | Turner | 242/86.5 A |
| 3,443,772 | 5/1969 | Prosser | 242/86.5 A |
| 3,456,891 | 7/1969 | Parr | 242/86.5 A |
| 3,547,371 | 12/1970 | Gruseck | 242/107 |
| 3,817,472 | 6/1974 | Abe | 242/107 |
| 3,964,425 | 6/1976 | Septor | 242/86.5 A |
| 4,232,837 | 11/1980 | Cutler | 242/107 |
| 4,306,688 | 12/1981 | Hechler | 242/96 X |
| 4,416,429 | 11/1983 | Jessamine | 242/86.5 A |
| 4,429,839 | 2/1984 | Jessamine | 242/86.5 A |

*Primary Examiner*—John M. Jillions

*Attorney, Agent, or Firm*—Don W. Weber

[57] ABSTRACT

An automatic ski rope rewinding device is presented used to rewind a ski rope when the rope is not pulling a skier. The invention utilizes a standard rope or cord rewinding mechanism which is mounted by L-shaped brackets to the body of the boat. The rewinding mechanism and rope are encased by an outer, waterproof casing. A water removing gasket facilitates removal of water from a rope being rewound and a loop near the attached end of the ski rope is used to directly attach the ski rope to the boat cleat when pulling a skier.

7 Claims, 2 Drawing Sheets

ROPE REWINDING DEVICE FOR A SKI BOAT

BACKGROUND OF THE INVENTION

This invention relates to an automatic ski rope rewinding device for a speed boat. This device is used in the field of watersports and more particularly in the field of containers or winding devices for ski ropes.

In the sport of waterskiing it is necessary to use a long amount of rope which has one end attached to the back of a ski boat. The other end of the rope has a handle attached thereto which is held by the waterskier as the boat pulls the skier along the water. When an accident occurs or upon intentional release of the ski rope handle by the skier, the rope becomes slack and floats in the water. This condition could create a dangerous circumstance should the driver of the boat cross over the ski rope towline and thus entangle the ski rope in the propeller of the boat.

One object of this invention is to create a device which automatically rewinds the ski rope upon release of tension from releasing the loop from the boat cleat.

Several methods have been devised to store a ski rope when not in use. The ski rope apparatus found in U.S. Pat. Nos. 4,416,429 and 4,429,839 both direct themselves to this general field. However, the ski rope reel apparatus as set out in both patents do not automatically rewind ski rope to the compact position.

Devices have been patented which direct themselves narrowly to automatically rewinding a ski rope once tension is released. The patent issued to Abe, U.S. Pat. No. 3,817,472 is one such device. The Abe patent provides a take-up reel which automatically rewinds the rope by means of a coiled spring which is in cooperable connection with planetary gears and the take-up reel. Other devices well known in the separate arts of automatically retracting power cords or seat belts have utilized a spring mechanism for taking up an electrical cord or seat belt. U.S. Pat. No. 3,817,473 describes a take-up reel for a retractable safety belt. U.S. Pat. No. 4,232,837 generally describes a take-up reel for an electrical cord. None of the devices cited attack or solve the particular problem herein related to the use of a ski rope in water.

Retractable safety belts or retractable power cords are not designed to withstand an amount of tension placed on the unattached end of the cord. Furthermore, while the Abe patent does direct itself to the problem of pulling a skier at the end of a ski rope, the Abe device relies on the integrity of the reeling device itself to withstand the pressure supplied by pulling a skier. (See Abe, column 2, lines 55–58.)

Another problem in the retractable ski rope art has been the corrosion of the internal spring mechanism and planetary gears caused by either fresh or salt water. Since fresh or salt water is commonly encountered in the ski rope field, such corrosion is a major factor in the design and operation of an automatically retractable ski rope. It is further to be noted that a great deal of stress is placed on any winding mechanism by a skier.

It is an object of this invention to provide a new device which is corrosion resistant and designed to eliminate or greatly reduce the amount of water which is taken in by a rewinding mechanism.

Another object of this invention is to create a device wherein the ski rope is positively attached to the stern of the boat. A further and corollary object of this invention is to create an automatic ski rope rewinding device which need not be so firmly attached to a boat as to withstand the tension provided when the boat pulls the skier.

Further and other objects of the invention will become apparent upon perusal of the following description of the invention.

BRIEF SUMMARY OF THE INVENTION

An automatic ski rope rewinding device for a ski boat is presented comprising a reel for winding the ski rope, an automatic rewinding means in cooperation with that reel, a casing completely surrounding the reel and rewinding means which may be attached either to the outside of a boat or to the inside rear floor of the boat, and a ski rope which is attached to the reel and which automatically rewinds. The end of the ski rope that is attached to the reel has a permanent loop therein. When the rope is extended the loop is positively attached to the stern of the boat. The boat then pulls the skier directly. Special water-removing gaskets have been provided for the casing so as to either entirely eliminate or greatly reduce the amount of water on the rope which ultimately makes its way inside the inner casing and hence to the metallic mechanisms of the automatic rewind means.

DETAILED DESCRIPTION OF THE PREFERRED EMBODIMENT

The device described herein is of simple construction and lightweight, yet durable. The device is constructed of essentially four main parts: an outer essentially waterproof casing, a take-up reel for the ski rope, a ski rope attached to the reel with a loop near the end of the rope, and a rewinding mechanism which operates to rewind the rope automatically once tension is released.

Figure 2:
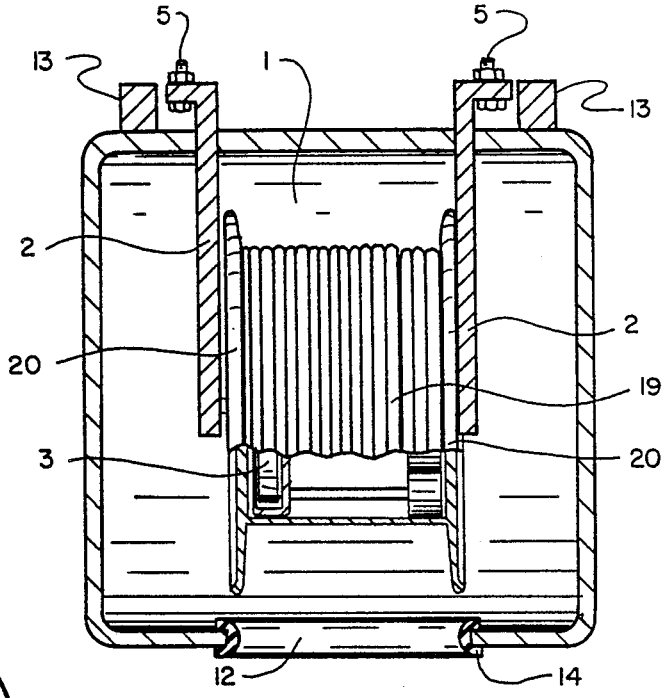
FIG. 2 is cut-away view of the device along lines 2—2 in FIG. 1.

The take-up reel 1 is generally shown in FIG. 2. The take-up reel consists of a central spool 19 having two flanged ends 20 on either side thereof. The take-up reel is rotatably mounted to the boat by means of reel brackets 2. These reel brackets are generally L-shaped and have a hole at the top of the bracket for receiving the hub of the take-up reel. The brackets are at a perpendicular direction to the axis of rotation of the take-up reel and have the bottom of their L-shaped foot protruding outside the casing 9. The brackets 2 are attached by bolts 5 to the boat in a conventional manner.

Cooperably connected to the take-up reel is a spring operated rope rewinding means, composed of a coiled spring, planetary gears 3 and a means connecting the rewinding mechanism to the take-up reel 19. This rope rewinding means is well known in the art which relates to retracting electrical cord, seat belts, and even ski ropes. See, for example, the retractable means described in the Abe U.S. Pat. No. 3,817,472. Any suitable automatically rewinding retractable means for the take-up reel will suffice for this invention. The only requirement is that the rewinding means automatically retract the extended rope and loop once tension is released by the skier.

Figure 1:
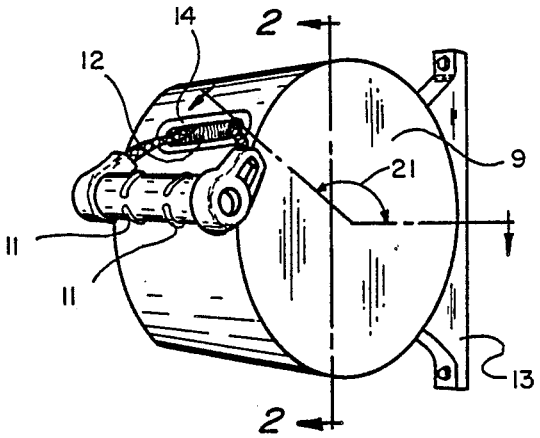
FIG. 1 is a perspective view of the device designed to be attached to the outside stern of a boat.

The take-up reel and rewinding means are mounted on the inside of the casing 9. The casing 9 is essentially a water tight casing which is cylindrical in shape and which has casing feet or brackets 13 as shown in FIG. 1. The casing is preferrably made of fiberglass or hard plastic so as to be completely water resistant. The take-up reel and rewinding means are secured to the inside of the casing so that the casing completely covers the reel and rewinding mechanism.

Wound about the reel is a rope 4 containing a loop near the reel end. The rope is securely attached to the reel and the loop 15 (which is approximately 6 feet from the reel end of the rope) pulls out and rewinds as necessary. The near end of the rope 7 is secured to the reel 1 by conventional means. The free end of the rope 6 has attached to it a ski handle 8 in the normal manner well known in the art.

The casing 9 of the invention is essentially cylindrical. The casing also has casing brackets or feet 13 which are used to attach the casing to the boat. Securing the casing brackets 13 to the outside stern of the boat 10 is the preferable method of attaching the device to a ski boat.

Also attached to the casing are handle clips 11. These clips may be of plastic or other suitable material. The clips 11 are semi-circular in form and are made of a resilient material such that placing the ski handle 8 in the clips as shown in FIG. 1 will secure the handle to the casing.

Figure 3:
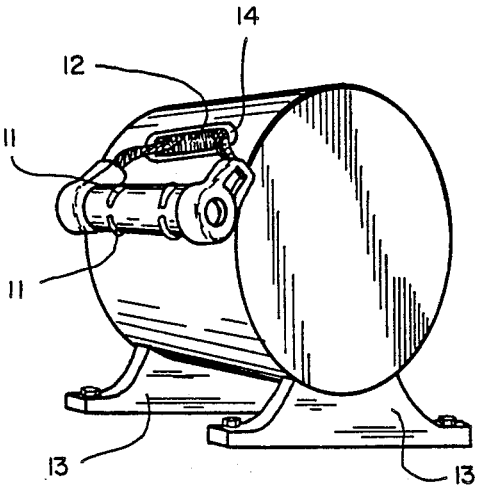
FIG. 3 is an alternate embodiment of the device shown in perspective wherein the device is mounted on the inside of the boat as shown in FIG. 4.

Also unique to this device is a rope slot 12 as shown in FIGS. 1 and 3. This rope slot 12 is used so that the rope may freely move from the coiled to the unwound position and back to the coiled position on the reel 1. Around the inside perimeter of the rope slot is found a water-removing gasket 14. This water-removing gasket may be made of a sponge material or similar substance which removes and absorbs water as the ski rope is drawn through the rope receiving slot. The purpose of this unique gasket is to eliminate, as far as possilbe, water or moisture from reaching the interal mechanism of the reel and rewinding device.

Figure 5:
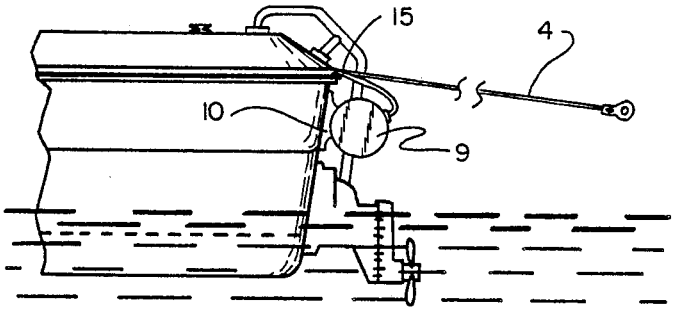
FIG. 5 is a side view of a ski boat showing the device attached to the outside stern thereof.

In the embodiment of the invention as shown in FIGS. 1 and 5 the device is attached to the outer stern 10 of the boat. When the device is attached in this manner, the water-proof gasket 14 and rope slot 12 are located opposite the vertical stern of the boat and opposite the casing brackets, as shown. The gasket and rope slot may be in the location shown or it may be at any angle suitable to insure easy operation of the mechanism rewinding device. Angle 21 may vary within the spirit of this invention.

Figure 4:
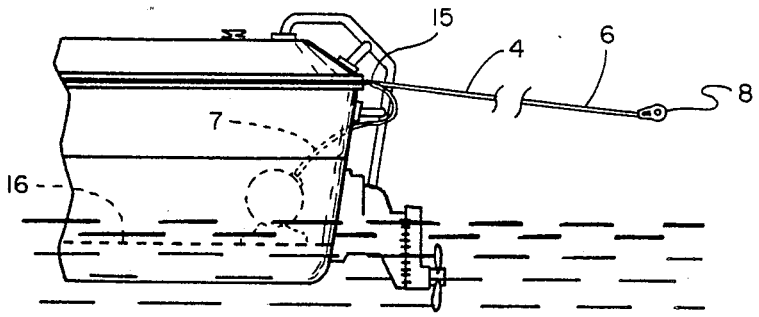
FIG. 4 is a side view of the ski boat with the device mounted on the inside of the boat.
Figure 6:
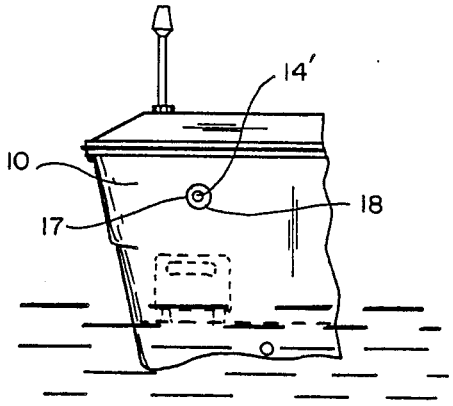
FIG. 6 is a rear view of a ski boat showing the stem aperture and stem aperture water-removing gasket.
Figure 7:
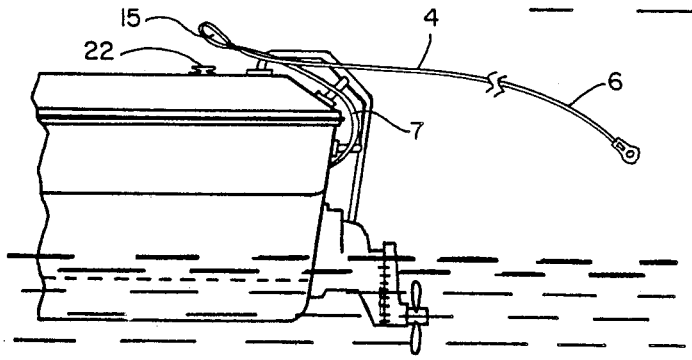
FIG. 7 is a close-up view of the rear of the ski boat showing the loop and cleat.

In the alternative embodiment shown in FIGS. 3, 4 and 6, the casing is located on the floor near the rear of the boat. In this embodiment the rope slot 12 is located at an angle to the floor 16.

As in the embodiment which is attached to the stern of the boat shown in FIG. 5, the rope slot of FIG. 6 also has a water-removing gasket 14. This water-removing gasket is similar in both embodiments. Since the casing is attached to the floor inside the boat in this second embodiment, it is necessary to drill a hole in the stern of the boat. This stern aperture 17 should be large enough for the ski rope to pass through. The stern aperture 17 has about its perimeter a stern aperture water gasket 18. This stern aperture water gasket is constructed of material similar to the water-removing gasket about the perimeter of the rope slot in the outside embodiment of FIGS. 1 and 5. The purpose of both the water-removing gasket about the perimeter of the rope slot and the stern aperture water gasket about the perimeter of the stern aperture is to eliminate, as far as possible, any water or moisture which has accumulated on the rope as it is drawn onto the reel. These gaskets help reduce the moisture which eventually would tend to corrode the inner mechanism of the reel and rewinding device. In both embodiments shown in FIGS. 4 and 5 the actual reel and rewinding mechanism are securely fastened to the boat by means of the reel brackets 2 and bolts 5. These reel brackets are located with one end on the inside of the casing and the other end with perpendicular feet protruding outside the casing. The casing is mounted to the boat by bolts being placed through the bracket feet and securely fastened to the stern of the boat as shown in FIG. 5 or the floor of the boat as shown in FIG. 4.

In the operation of this particular device, a main advantage is obtained by utilizing the loop 15 near the near end 7 of the rope 4. In order to water- ski the rope is extended until the loop 15 is presented. The loop 15 is then attached independently and directly to a convenient cleat 22 on the boat. The boat then pulls the skier directly. Since the pulling is all done from the loop attached directly to the boat cleat, less stress is placed on the casing and rewinding mechanism. It has been found that using the standard boat cleat engaging means by attaching the loop to the boat cleat 22 directly provides for a longer lasting and more reliable rewinding mechanism.

The casing itself can be fabricated from a unitary molding process. The reel and rewinding mechanism are inside the unitary casing and the reel and rewinding mechanism are bolted to the boat by the protruding feet of the brackets 2. Since the metal brackets 2 are L-shaped, as shown in FIG. 2, and since they protrude from the casing 9, the entire device may be mounted to the boat without necessity for in any manner invading the inside of the casing.

Due to the compactness and water-proof construction of this device more than one such automatic rewinding device may be mounted on a single boat. Because the casing protects the movable parts of the mechanism it is much safer than other unprotected mechanisms. No exposed gears are present to cause injury. Additionally, the water-removing gaskets add a specially suitable means for preventing early breakdown due to corrosion of the device.

In practice it has been shown that the water-removing gaskets 14 on the casing or the stern aperture water gasket 18 on the stern aperture should have a hole therein approximately the diameter of the inside of the rope. The sponge or foam substance used for the gasket material will tend not only to mechanically remove water which has accumulated on the rope due to the size constrictions, but it will also tend to absorb the moisture from the rope due to the absorbent nature of the material used for the gaskets.

A final and more simple embodiment of this invention can be constructed by merely mounting a standard take-up reel to the inside of the casing by means of the reel brackets 2. This could be accomplished, for example, by taking a device such as described in U.S. Pat. No. 4,232,837 and attaching a rope with a loop thereon. This entire device would then be encased by the casing described above and attached to the boat in the manner previously recited. This simple embodiment of the device would then embody many of the features of the present invention. The specially adapted water-removing gaskets and loop in the rope plus the specially conceived mounting means would then complete the embodiment of the invention.

Having fully described and disclosed my invention, I claim:

1. An automatic rope rewinding device for a ski boat, comprising:

(1) a reel for winding a ski rope rotatably attached to the stern of a ski boat by means of L-shaped reel brackets;

(2) an automatic, spring operated rope rewinding means in cooperable connection with said reel;

(3) a ski rope secured to said reel having a handle attached at the free end of said rope and a knotted loop near the secured end of said rope; and (4) an outer casing completely surrounding said reel, rewinding means and rope, permanently attached to the outside stern of a ski boat, said outer casing having handle receiving clips on the outside thereof and a rope-receiving slot opposite the stern of said boat, said rope slot further comprising a water-removing gasket therein;

2. An automatic rope rewinding device for a ski boat, as in claim 1, wherein said casing is essentially water-tight.

3. An automatic rope rewinding device for a ski boat as in claim 1, wherein said reel brackets comprise metal angles which protrude through said casing and are attached to the stern of said ski boat by means of bolts.

4. An automatic rope rewinding device for a ski boat as in claim 1, wherein said water-removing gasket is made of sponge material or rubber or similar material which removes water as the ski rope is drawn through said rope-receiving slot.

5. An automatic rope rewinding device for a ski boat as in claim 1, wherein said casing is made of fiberglass or similar hard, lightweight, non-corrosive material.

6. An automatic rope rewinding device for a ski boat, comprising:

(1) a reel for winding a ski rope rotatably attached to the floor of a ski boat by means of reel brackets;

(2) an automatic, spring operated rope rewinding means in cooperable connection with said reel;

(3) a ski rope secured to said reel having a handle attached at the free end of said rope and a knotted loop near the secured end of the rope; and (4) an outer casing completely surrounding said reel, rewinding means and rope, permanently attached to the inside rear floor of a ski boat, said an outer casing having a rope receiving slot essentially perpendicular to the point of attachment of said casing to the floor; and (5) a stern aperture having a water-removing gasket therein.

7. An automatic rope rewinding device for a ski boat as in claim 6, wherein said stern aperture water removing gasket is made of sponge material or rubber or similar material which removes water as the ski rope is drawn through said stern aperture.

* * * * *